US005294004A

United States Patent [19]

Leverett

[11] Patent Number: 5,294,004

[45] Date of Patent: Mar. 15, 1994

[54] ARTICLE-HOLDING CUP AND SCALE FOR APPARATUS THAT SORTS ARTICLES BY WEIGHT

[75] Inventor: William H. Leverett, Greenville, Ga.

[73] Assignee: Durand-Wayland, Inc., LaGrange, Ga.

[21] Appl. No.: 746,697

[22] Filed: Aug. 19, 1991

[51] Int. Cl.[5] ..... B07C 5/16

[52] U.S. Cl. ..... 209/592; 209/698; 209/707; 209/912; 198/365; 198/384; 177/145

[58] Field of Search ..... 209/556, 592, 593, 646, 209/698, 707, 912; 198/365, 366, 370, 384, 534; 177/145

[56] References Cited

U.S. PATENT DOCUMENTS

| | | | |
|---|---|---|---|
| 2,980,252 | 4/1961 | Bray et al. . | |
| 3,545,614 | 12/1970 | Sheetz . | |
| 3,580,381 | 5/1971 | Kilner | 198/384 |
| 4,254,877 | 3/1981 | Rose | 209/912 X |
| 4,262,807 | 4/1981 | Leverett | 209/592 |
| 4,426,006 | 1/1984 | Horii et al. | 209/912 X |
| 4,482,061 | 11/1984 | Leverett | 209/592 |
| 4,489,822 | 12/1984 | Hiebert . | |
| 4,585,126 | 4/1986 | Paddock et al. | 198/452 X |
| 4,586,613 | 5/1986 | Horii | 209/912 X |
| 4,660,665 | 4/1987 | Powell, Jr. | 177/145 |
| 4,830,195 | 5/1989 | De Greef | 209/912 X |
| 4,940,536 | 7/1990 | Cowlin et al. | 209/592 |
| 5,024,047 | 6/1991 | Leverett | 209/912 X |
| 5,044,504 | 9/1991 | Powell, Jr. | 209/592 X |

FOREIGN PATENT DOCUMENTS

| | | |
|---|---|---|
| 0060013 | 9/1982 | European Pat. Off. . |
| 0108445 | 5/1984 | European Pat. Off. . |
| 0231979 | 8/1987 | European Pat. Off. . |
| 2142580 | 2/1973 | France . |
| WO91/04803 | 4/1991 | PCT Int'l Appl. . |

*Primary Examiner*—D. Glenn Dayoan
*Assistant Examiner*—Tuan N. Nguyen
*Attorney, Agent, or Firm*—Jones & Askew

[57] ABSTRACT

In an article sorting apparatus with two parallel, spaced-apart continuous conveyors which pass through a loading zone, a weighing zone, and a discharge zone, having fabric flaps disposed on spaced-apart rods connected between the two conveyors for gently receiving articles selectively discharged for grouping with other articles having a similar determinable characteristic, an article-holding cup and scale providing such apparatus capability to select by weight. The cup includes an L-shaped arm extending outward and downward from one side and a pin extending outward from an opposite side. The free end of the arm extends to the scale below the horizontal plane in which the rods travel. The rods pass over the scale while the cups travel on rails in the weighing zone so that the weight of the article in each cup may be determined.

6 Claims, 7 Drawing Sheets

ARTICLE-HOLDING CUP AND SCALE FOR APPARATUS THAT SORTS ARTICLES BY WEIGHT

TECHNICAL FIELD

The present invention relates generally to an apparatus for sorting articles by weight. More particularly, the present invention relates to an article-holding cup and a scale for such a sorting apparatus.

BACKGROUND OF THE INVENTION

Many types of bruiseable fruits and vegetables are sold in bags with a pre-printed weight. Such fruits and vegetables include apples, oranges, avocados, pears, onions, and the like. Apparatus for weighing and sorting such fruit or vegetable articles have been described before. Such apparatus typically has a continuous conveyor carrying a plurality of pivotable cups. Each cup receives an article of fruit or vegetable in a loading zone from a supply of articles. The cups pass in sequence over a scale in a weighing zone to determine the weight of the article in each cup. The cups then pass in sequence through a discharge zone. Each article selectively discharges at an appropriate discharge station to group together articles of similar weight.

U.S. Pat. No. 4,254,877 describes a weight sizing apparatus having a plurality of discharge stations. An article discharges at a station onto a take-away conveyor which carries the article with others having a weight in the selected range for packing. To reach the take-away conveyor, the article drops onto a deflection ramp having a soft surface to cushion the fall of the article. The ramp directs the article to the take-away conveyor for grouping with other articles. This sorting apparatus has the disadvantage of subjecting the article to a free-fall, and unnecessarily risks bruising or otherwise damaging the article.

One known apparatus for sorting fruits and vegetables utilizes a fabric flap to transfer more gently a selected article from a cup attached to the continuous conveyor onto the take-away conveyor for its selected group. The fabric flap is held on a rod connected normal between two parallel continuous conveyors. The apparatus includes a plurality of the flaps and the rods which are spaced apart between the conveyors. The rods travel in a horizontal plane below the cup. The take-away conveyor is disposed below the continuous conveyor carrying the cups and articles for sorting. Each cup receives an article in a loading zone from a supply of articles. Instruments such as an optical sensor scan each article from several angles to classify the property of the article. The classified articles pass through the discharge zone. The article discharges from the cup at a selected discharge station according to the classification of the article. The cup carrying the article pivots upward to move the article from the cup toward the adjacent fabric flap. During discharge, the fabric flap falls into the receiving area. The fabric flap cushions the transfer of the article to the take-away conveyor. The conveyor continues moving, pulling the fabric flap from the receiving area so that the article rolls off the fabric flap onto the take-away conveyor. Thus, an apparatus is provided for sorting articles into groups while reducing the damage to the article from handling.

However, it has not been possible to use fabric flaps attached to rods connected between parallel conveyors in an apparatus which sorts the articles by weight. The scale occupies the space in which the rods would travel. The scale in a weighing and sorting apparatus has a square U-shape defined by a cross member and two upright parallel rails. The article-holding cup travels on the upper cam surfaces of the rails when the article is weighed. The cross member connects to a load cell, as is well known in the art, with appropriate instrumentation for determining the weight of the article. In a sorting apparatus using fabric flaps, the rods holding the fabric flap connects between the conveyors. The rods, disposed vertically below the article-carrying cup, travel in a horizontal plane. If a scale were present, the rails would extend through the plane in which the rods travel as moved by the conveyor. The rails accordingly would block the passage of the rods and prevent the conveyors from passing through the apparatus.

Therefore, there remains a need in the art for an improved apparatus for sorting articles by weight which also reduces damage to the articles by discharging selected articles onto fabric flaps to cushion the transfer of the articles into groups.

SUMMARY OF THE INVENTION

The present invention solves the need in the art by providing a cup and scale for use with an apparatus for sorting articles by weight with reduced damage from handling by discharging the articles onto fabric flaps. Generally described, the cup includes two supports by which the cup contacts the scale for weighing. The supports are off-set vertically; that is, one support extends below the cup a greater distance than the other. The scale includes rails having cam surfaces on which the supports travel as the cup is weighed. The rails similarly are off-set vertically. A shorter rail aligns with the longer support; a taller rail aligns with the shorter support. The total lengths from each set of aligned support and rail are the same on both sides of the cup. In this manner, the cup is carried horizontally on the scale. The rods holding the fabric flaps are disposed in a horizontal plane above the cam surface on the shorter rail. The rods accordingly pass over the rail.

More particularly described, the present invention provides a cup and scale for an apparatus that groups articles by weight while reducing the handling damage to the articles. The article-holding cup includes a pin and an L-shaped arm extending outward from opposite sides. The arm extends downward away from the bottom edge of the cup. The pin is horizontally disposed in alignment with the bottom of the cup. The free end of the arm and the pin are accordingly spaced-apart vertically. The scale includes a pair of parallel, spaced-apart rails having upper cam surfaces. The cam surfaces are contacted by the pin and the free end of the arm when the cup is being weighed. The height of the rails are different. The shorter rail aligns with the L-shaped arm; the taller rail aligns with the pin. The total vertical distance of the aligned arm and rail is the same for the aligned pin and rail on the opposite sides of the cup. This permits the cup to be horizontal during weighing. Handling damage is reduced by discharging the selected article onto the fabric flap between the conveyors to cushion the transfer of the article from the cup to the take-away conveyor. A plurality of spaced-apart rods each carry a fabric flap. The ends of each rod connect perpendicular to the conveyors. The rods travel in a horizontal plane above the cam surface of the shorter rail. The rods thereby pass over the scale while the cups contact the scale for weighing.

Accordingly, it is an object of the present invention to provide an improved weighing and sorting apparatus that reduces handling damage to articles.

It is another object of the present invention to provide a cup and a scale for a weighing and sorting apparatus.

It is another object of the present invention to provide a cup and a scale for a sorting apparatus using fabric flaps for discharging articles selectively into the appropriate weight group.

It is another object of the present invention to provide a cup having vertically off-set supports for use in an article weighing and sorting apparatus that reduces the rough handling of articles necessary to sort such articles into groups having a common range of weight.

It is another object of the present invention to provide a cup for a sorting apparatus having a fabric flap carried by a lateral rod disposed below the cup.

Other objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
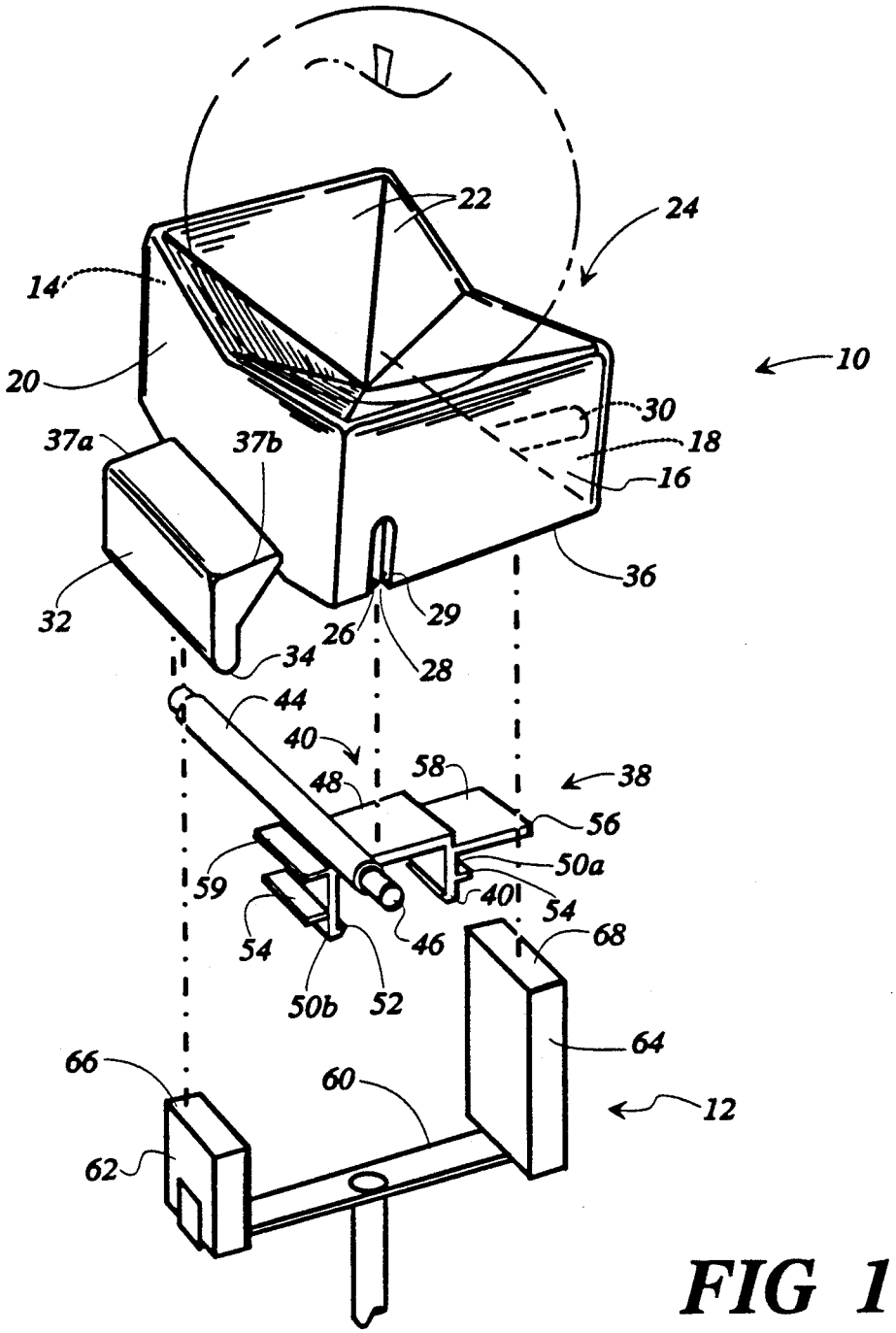
FIG. 1 is an exploded perspective view of the cup and scale constructed in accordance with a preferred embodiment of the present invention.

Referring now in more detail to the drawings in which the same parts have like identifiers, FIG. 1 is an exploded perspective view of the improved cup 10 and the scale 12 constructed in accordance with a preferred embodiment of the present invention. The cup 10 comprises a front wall 14, a back wall 16, an outside wall 18 and an inside wall 20. The walls join together to form a periphery skirt. The terms "front," "back," "outside" and "inside" relate to the orientation of the cup with respect to the conveyor on which the cup 10 pivotally attaches. By way of illustration of these terms and with reference to FIG. 2, the inside walls 20*a* and 20*b* of the cups 10*a* and 10*b* face inwardly towards the respective opposite cup and conveyor.

A plurality of inwardly sloping walls 22 extend from the upper edge of the walls 14, 16, 18, and 20. The walls 22 define a cavity 24 for holding an article (shown in phantom). In an alternate embodiment (not illustrated), the walls 22 include holes so that fluids or small trash such as stems and leaves fall from the cup and so as to facilitate washing of the apparatus.

The front wall 14 and the back wall 16 on the opposite side of the cup each include a vertical elongate slot 26 near the inside wall 20. The slots 26 are transversely aligned with respect to each other. Each vertical slot 26 extends upward from an open end 28 at the bottom edge of the wall. A pair of opposed lugs 29 at the open end 28 project towards each other from the sides of each slot 26.

The cup 10 includes a pin 30 and an L-shaped arm 32. The pin 30 extends laterally from the outside wall 18. The arm 32 extends laterally from the outside the inside wall 20. The arm 32 includes a free end 34 extending below a lower edge 36 of the cup 10. The pin 30 is disposed with its bottom surface horizontally aligned with the lower edge 36. The pin 30 and the free end 34 are thus spaced-apart vertically. The pin 30 aligns with the transverse axis of the cup. The front and back edges 37*a* and 37*b* of the arm 32 are equidistant from the transverse axis. In the illustrated embodiment, the bottom surface of the free end 34 is planar. In an alternate embodiment (not illustrated), the bottom surface includes a pair of spaced-apart projections. The projections cooperate with the pin 30 to provide a three-point support of the cup in the weighing zone.

As shown in exploded view, the cup 10 includes a bracket 38 for connecting the cup 10 to a conveyor in the sorting apparatus, as discussed below. The bracket 38 comprises a U-shape chain clip 40, an arm 42 (best illustrated in FIG. 7A) extending outwardly and upwardly from the chain clip 40, and a pivot pin 44. The pivot pin 44 is integral with the angled arm 42 extending from the chain clip 40. The longitudinal ends 46 of the pivot pin 44 insert loosely into the slots 26 of the cup 10. The lugs 29 extend outwardly a distance sufficient to hold the end 46 in the slot 26 but still permit the end 46 to snap past and into the slot 26 during assembly. The width of the slot 26 is sized to permit the pin 44 to move vertically in the slot. The cup 10, accordingly, is freely pivotably about the pivot pin 44. The cup 10 also is movable vertically when in a horizontal position. This vertical movement permits the cup 10 to be weighed independently of the conveyor which carries the cup 10.

The chain clip 40 defines an upside down U-shape with a base 48 and two legs 50*a* and 50*b*. Each leg 50 terminates in a inwardly extending tooth 52. A flange 54 extends laterally outward from a lower portion of the side of each leg 50. An arm 56 extends from an upper portion of the leg 50*a* toward the outside wall 16 of the cup 10. An upper surface 58 of the arm 56 contacts the lower edge 36 of the outside wall 16 when the pivot pin 44 is at the top of the vertical slot. The pivot pin 44 and the arm 56 thereby cooperate to carry the cup 10 horizontal on the conveyor. A second arm 59 extends from an upper portion of the leg 50*b*. This second arm 59 acts as a stop against the interior surface of the inside wall 20*a*. This stops the cup from pivoting beyond a predetermined amount.

FIG. 1 further illustrates the scale 12 which cooperates with the cup 10 for weighing an article held in the cup 10. The scale 12 includes a weighing platform 60 and a pair of spaced-apart rails 62 and 64 disposed in general parallel alignment. The rails 62 and 64 connect to the sides of the U-shaped weighing platform 60. The weighing platform 60 connects to a load cell (not illustrated). The load cell provides analog signals which are fed through an amplifier and filter to an analog-digital converter. These analog signals are proportional to the weight detected by the load cell for both the cup 10 and its article. Such signals are converted to digital signals in the digital converter and are fed to a controller. The controller is programmed to associate the detected weight with the particular cup 10 on the scales. The nature and operation of such a scale in a weighing apparatus are known to those skilled in the art and are not further disclosed herein.

The rails 62 and 64 are in parallel alignment and each have an upper cam surface 66 and 68, respectively. The heights of the rails 62 and 64 are different. As illustrated, the height of the rail 62 is less than the height of the rail 64. The shorter rail 62 aligns with the L-shaped arm 32 and its free end 34. The taller rail 64 aligns with the pin 30. The free end 34 on the arm 32 travels on the upper cam surface 66 when the cup 10 is weighed. Similarly, the bottom surface of the pin 30 travels on the upper cam surface 68 during weighing. The total vertical distance for the aligned arm 32 and the shorter rail 62 is the same as that of the taller rail 64 aligned with the pin 30 on the opposite side of the cup 10. This permits the cup 10 to be horizontal during weighing.

Figure 2:
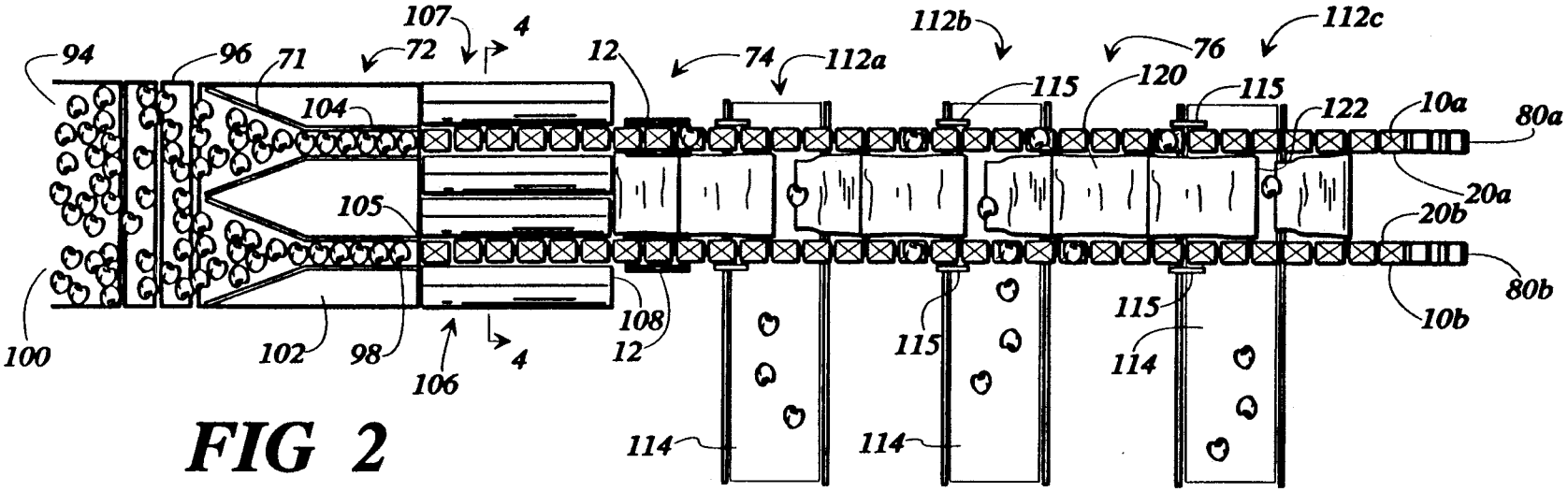
FIG. 2 is a top view of a weighing and sorting apparatus which uses the cup and the scale shown in FIG. 1.
Figure 3:
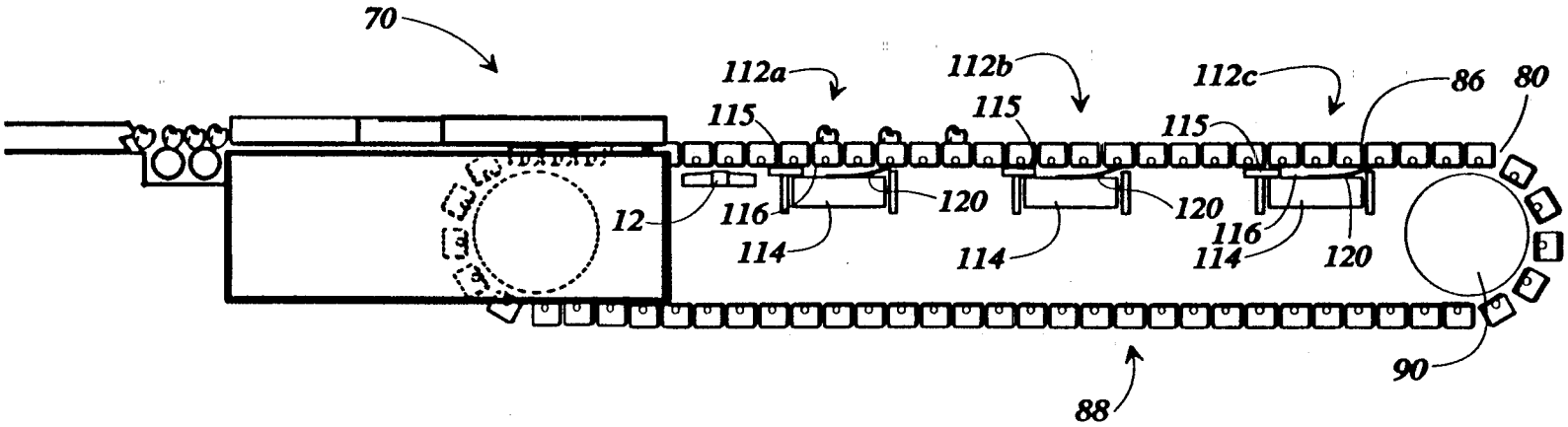
FIG. 3 is a side elevational view of the apparatus shown in FIG. 2.

FIGS. 2 and 3 illustrate in top view and in side view, respectively, an apparatus 70 for weighing and sorting articles. The apparatus 70 uses a plurality of the cups 10 constructed in accordance with the present invention for holding articles to be weighed on the scale 12 and sorted. In the illustrated embodiment, the apparatus 70 comprises a loading zone 72, a weighing zone 74, and a discharge zone 76. The cups 10 attach to a pair of continuous conveyors 80*a* and 80*b* that pass through the three zones for sequentially loading, weighing, and discharging articles.

Figure 6:
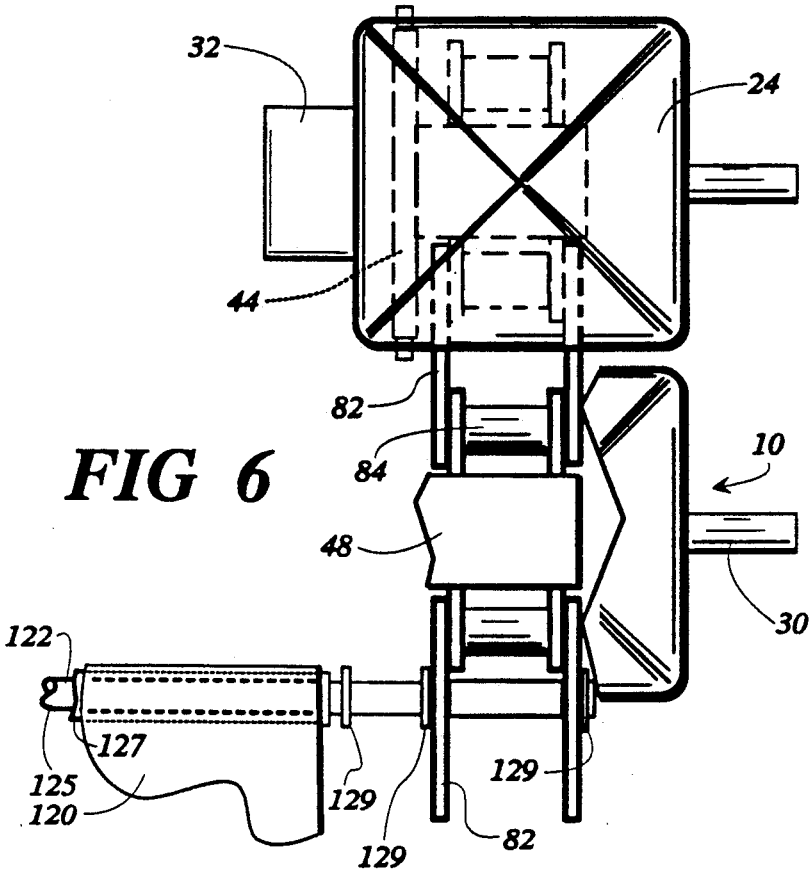
FIG. 6 is a fragmentary top view illustrating the rod shown in FIG. 5 connected to one of the pair of conveyors in the apparatus shown in FIG. 2.
Figure 8:
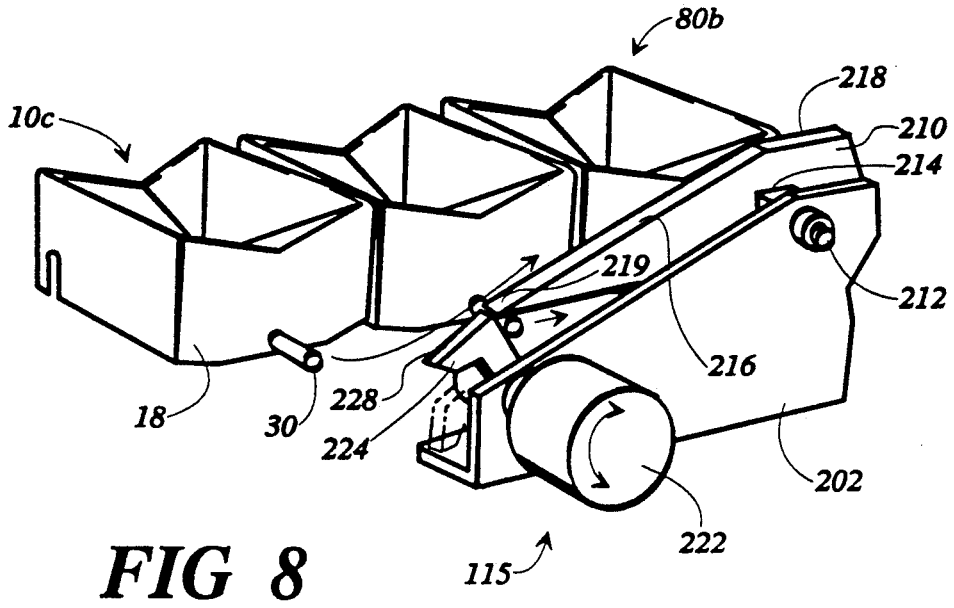
FIG. 8 is a perspective view of a discharge mechanism in the discharge station of the apparatus shown in FIG. 2.

The conveyors 80 are parallel and spaced-apart. Each conveyor 80 includes a continuous link chain. The link chain assembles from a plurality of plates 82 and rollers 84 (as best illustrated in FIGS. 6 and 8.) The rollers 84 in the chain are disposed horizontally. As illustrated in FIG. 3, each conveyor 80 has an upper flight generally designated 86 and a return flight generally designated 88. The conveyor is operatively engaged around a pair of spaced-apart sprockets 90. A drive motor (not illustrated) drives at least one of the sprockets 90. Each conveyor 80 accordingly travels in a vertical plane around the sprockets 90.

In the illustrated embodiment, the loading zone 72 includes a supply bin 94, a roller separator 96, and V-shaped singulators 98. The supply bin 94 includes a belt conveyor 100 to carry articles to the roller separator 96. The roller separator 96 separates the articles into rows. This maintains an orderly flow of articles from the supply bin 94 to the conveyors 80. Another belt conveyor 102 carries the articles through the V-shaped singulators 98. Each singulator 98 narrows to a trough 104 with an exit 105 adjacent the leading end of the upper flight 86 of one of the conveyors 80. A guide section 106 in the loading zone includes V-shaped troughs 107 (FIG. 4) formed by angled walls. A vertical wall 108 at the end of the guide section 106 blocks articles from leaving the loading zone 72 except on a cup 10. The section 106 accordingly guides a single article onto a cup 10.

The discharge zone 76 includes a plurality of selectable discharge stations 112. The illustrated embodiment has three stations 112*a–c* downstream of the weighing zone 74. Each station 112 includes a take-away conveyor 114 and a discharge mechanism 115. As shown in FIG. 3, the take-away conveyors 114 are disposed vertically below the upper flight 86 to define a receiving area generally designated 116. The take-away conveyors 114 extend laterally from the conveyors 80 and carry articles from the discharge station 112 to the packing equipment (not illustrated) that hold, fill, and transfer containers of articles. Such packing equipment is well known in the art. Each discharge station 112 includes the selectively activated discharge mechanism 115 (discussed below) to move an article from the cup 10 onto a selected carry-off conveyor 114. Each station 112 discharges articles having a weight within a range of weights and each station has a different range of weights. The final discharge station 112*c* receives all articles not previously discharged.

A fabric flap 120 is carried on one of a plurality of spaced-apart rods 122. The ends of the rods 122 connect to the conveyors 80*a* and 80*b*, as discussed below, so that the rods 122 are disposed perpendicularly between the conveyors 80. The fabric flaps 120 are not illustrated on the return flight 88.

Figure 4:
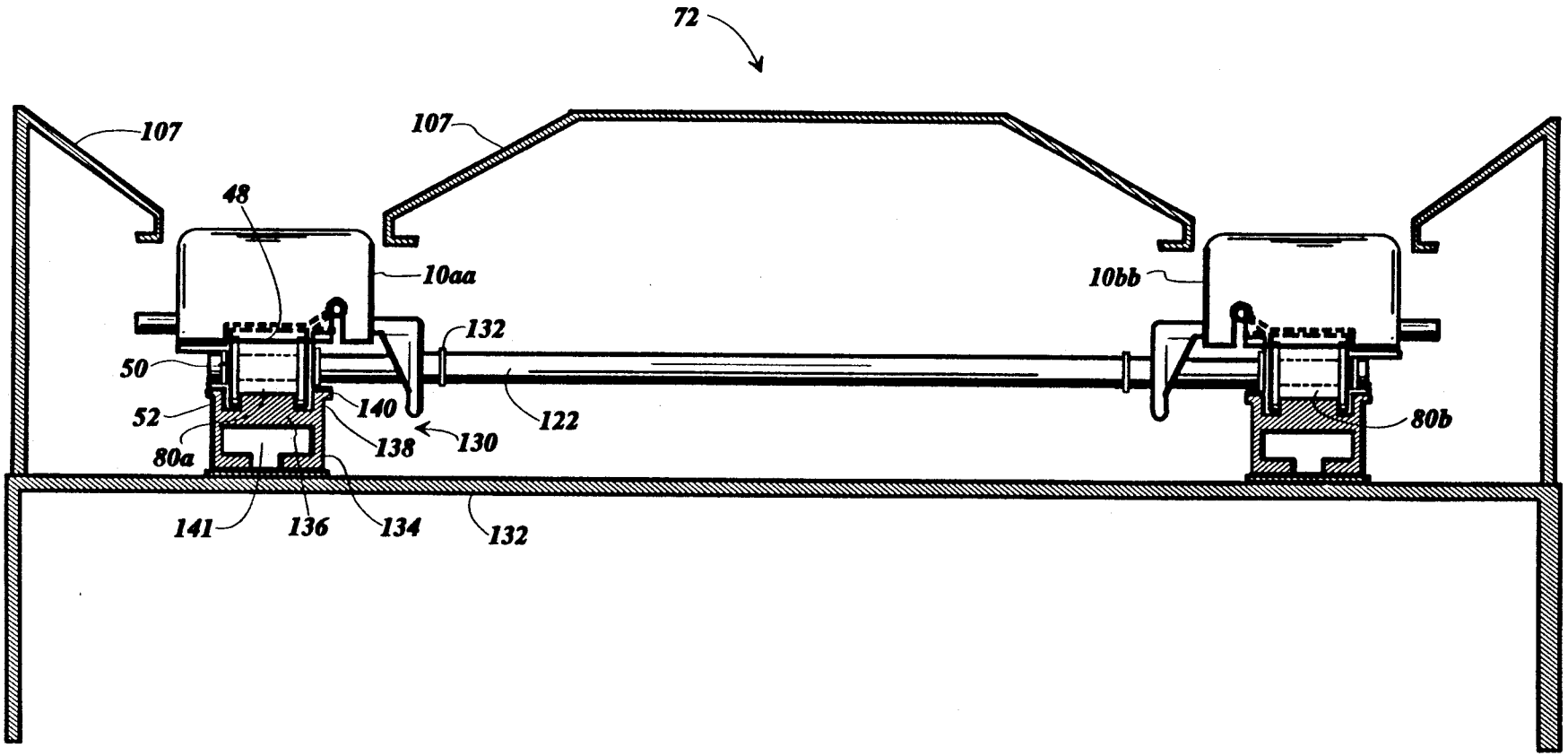
FIG. 4 is a cross-sectional view of the loading zone taken along line 4—4 in FIG. 2.

FIG. 4 is a cross-sectional view of the guide section 106 in the loading zone 72, taken along line 4—4 of FIG. 2. FIG. 4 illustrates the two parallel conveyors 80*a* and 80*b*, the cups 10*aa* and 10*bb*, and one of the rods 122 connected perpendicular between the conveyors. The conveyor chain travels in a track 130 which is secured to the frame 132 of the weighing and sorting apparatus. The track 130 has a base 134, an intermediate cross member 136, and a pair of side walls 138. A flange 140 extends outward laterally from the upper ends of the side walls 138. The intermediate cross member 136 cooperates with the base 134 to define a slot indicated as 141 for receiving one of a plurality of bolts (not illustrated) for securing the track 130 to the frame 132. The fabric flap 120 is not illustrated on the rod 122 in FIG. 4.

The cups 10 connect to the conveyors 80 by pushing the chain clip 46 onto a chain link of the conveyors 80. The chain clip 46 straddles the link plates 82 with the legs 50. The teeth 52 hold the clip 46 to the link from below. The flanges 54 of the chain clip 46 contact and travel on the flanges 140 extending from the side walls 138. The rollers 84 in the chain contact and travel on the upper surface of the cross member 136 of the track 130.

Figure 5:
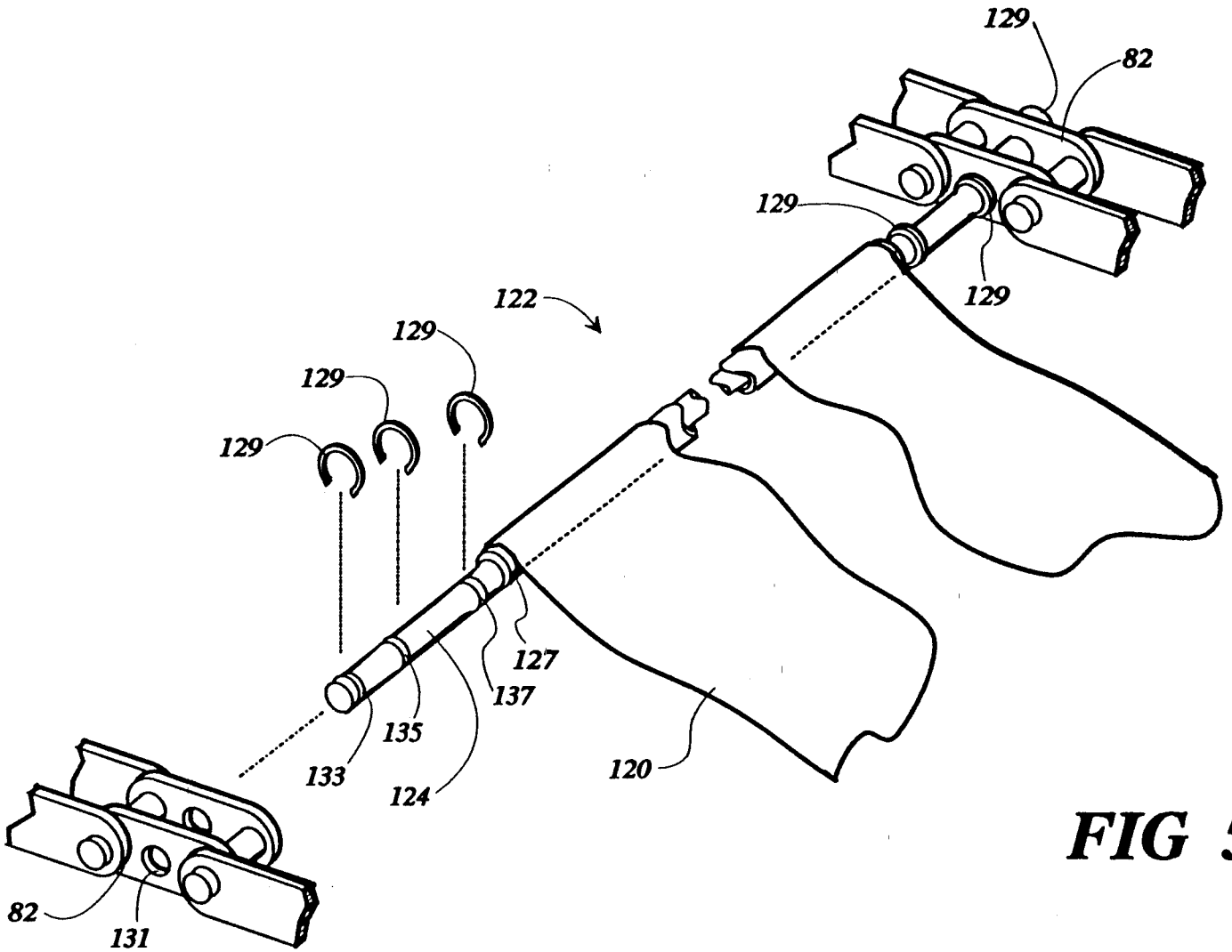
FIG. 5 is a perspective cut-away view of a rod that connects between the parallel conveyors of the apparatus shown in FIG. 2 and carries a fabric flap for receiving discharged articles.

FIGS. 5 and 6 illustrate one of the series of the rods 122 which are disposed perpendicular between the conveyors 80. Each rod 122 includes an attachment rod 125, a tube 127 loosely received on the attachment rod 125, the flap 120, and a plurality of stop rings 129. The ends of the attachment rod 125 insert through holes 131 in the respective opposite plates 82 of the conveyor chains 80*a* and 80*b*. Each end of the attachment rod 125 includes a plurality of grooves 133, 135, and 137 around the outer circumference of the rod. The groove 133 is disposed near the edge of the rod end. The end of the rod extends through the chain link so that the groove 133 is adjacent the side of the plate 82. The groove 135 is spaced apart from the groove 133 a distance slightly greater that the width of the conveyor chain. This positions the groove 135 near the side of the second plate 82 of the link in the conveyor chain. Each groove 133 and 135 receives one of the stop rings 129, which preferably are C-shaped rings that snap into the grooves. The rings 129 in the grooves 133 and 135 between the chain link loosely secure the end of the attachment rod 125 to the chain link. The rings 129 prevent the attachment rod 125 from moving laterally out of the holes in the plates and thus prevent the rod from moving out of engagement with the conveyor. Thus, the rod 122 is disposed perpendicular between the conveyors 80*a* and 80*b*.

Each of the grooves 137 is spaced apart from the groove 135 and also receives a stop ring 128. The grooves 137 cooperate to hold the tube 127 in position between the conveyors 80. The tube 127 is received on the attachment rod 125 and has a diameter greater than that of the rod so that the tube may freely rotate on the rod. FIG. 6 is a top view of the rod 122 connected to the chain of the conveyor 80*b*. One of the fabric flaps 120 attaches to each of the rods 122 by wrapping over the tube 127. One end of the flap 120 folds over and attaches to itself to form an open end loop. The tube 127 passes through the loop. The tube is received by the attachment rod 125 and the stop rings 129 snapped into the grooves 137. The attachment rod 125 is positioned through the holes 131 in the plates 82 and the stop rings 129 snapped into the grooves 133 and 135 to hold the attachment rod 125 in place. As the rod 122 moves with the conveyors 80, the fabric flap 120 moves through the discharge stations 112. The flap 120 falls into the receiving area 116 in each station 112 in sequence.

Figure 7:
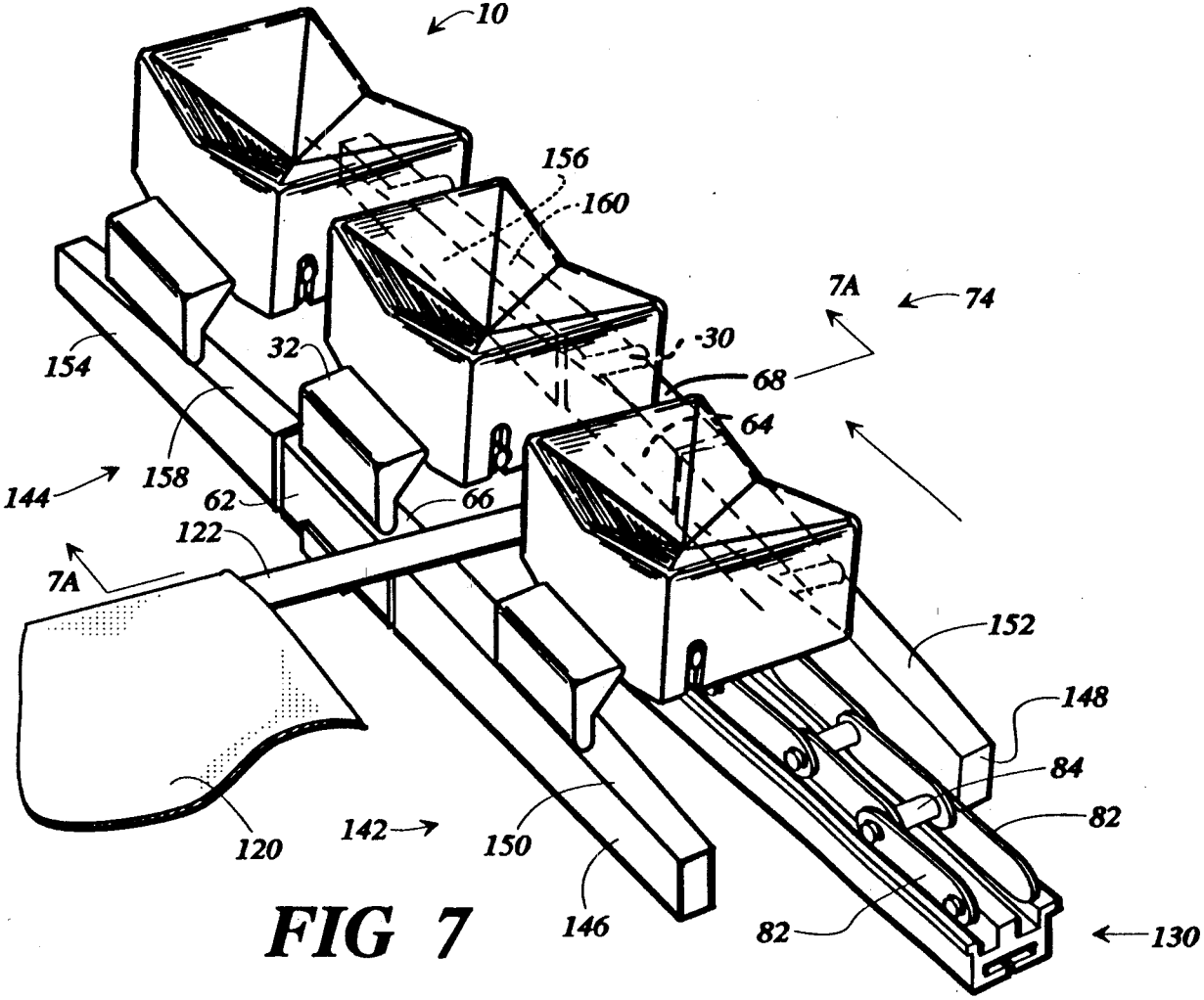
FIG. 7 is a cut-away perspective view of the weighing zone of the apparatus shown in FIG. 2.

With reference to FIG. 7, the weighing zone 74 includes an entrance ramp 142, and an exit ramp 144. The entrance ramp 142 includes a pair of parallel spaced apart side rails 146 and 148. The rails 146 and 148 each have upper cam surfaces 150 and 152, respectively, which taper upwardly in the direction of travel for the conveyor as indicated by the arrow. The height of the side rail 146 is lower than the height of the side rail 148. Similarly, the exit ramp 144 is defined by a pair of parallel, spaced apart rails 154 and 156. The rails 154 and 156 have cam surfaces 158 and 160, respectively, which taper downward in the direction of travel of the conveyor.

The leading end of the entrance ramp 142 is disposed vertically below the plane in which the free end 34 and the pin 30 travel. The rise between the leading and trailing ends of the entrance ramp is approximately the length of the vertical slot 24 in the cup 11. The height of the rail 62 is such that the connector rod 122 moves in a horizontal plane displaced vertically higher than the plane occupied by the upper cam surface 66 of the rail in the weighing zone 74.

Figure 7A:
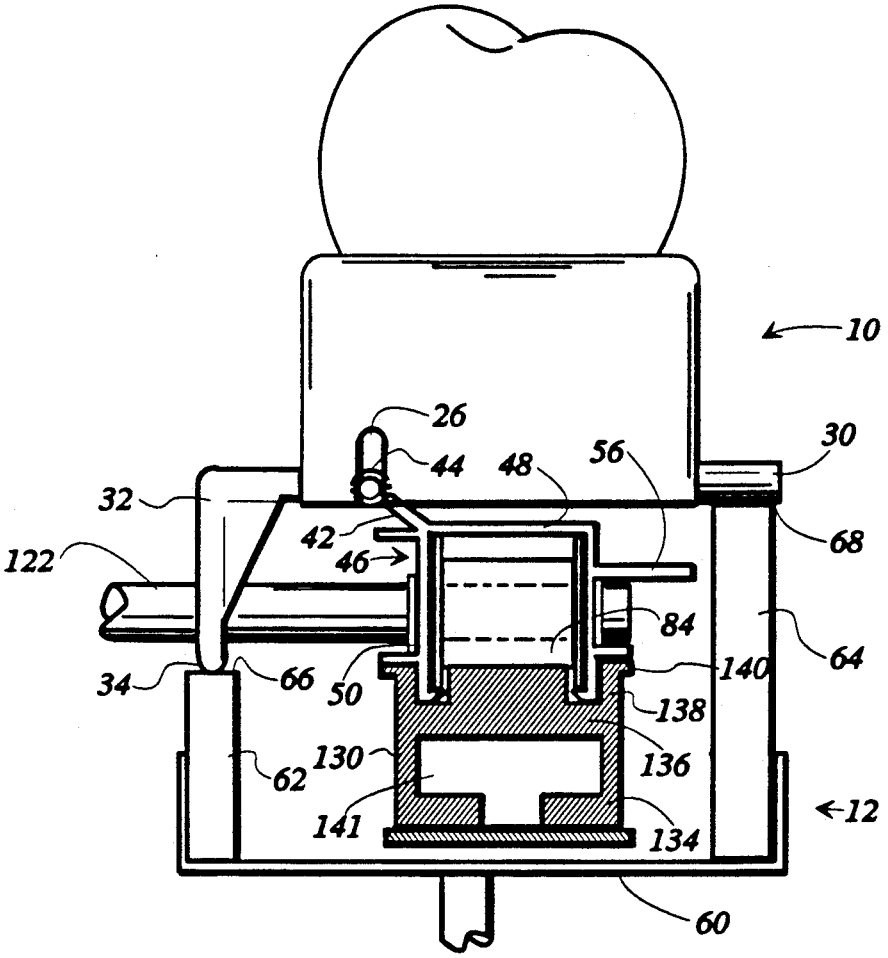
FIG. 7A is a cross-sectional view of the cup and scale in the weighing zone, taken along line 7A—7A of FIG. 7.

FIG. 7A is a cross-sectional view of the cup 10 supported by the pin 30 and the free end 34 on the scale 12 in the weighing zone 74, taken along line 7A—7A of FIG. 7. The pin 30 rests on the cam surface 68 of the rail 64. The free end 34 of the arm 32 rests on the cam surface 66 of the rail 62. The conveyor chain travels in the track 130. The rollers 84 of the chain travel on the upper surface of the cross member 136. The legs 50 of the chain clip 46 straddle over the plates 82 of the chain.

FIG. 8 illustrates in perspective view a discharge mechanism 115 for one of the discharge stations 112 in the discharge zone 76. The discharge mechanism 115 mounts to the apparatus adjacent the outside walls 18 of the cups 10. A bridge support 202 attaches to the frame (not illustrated). A bridge 210 connects to the top edge of the bridge support 202 with a plurality of bolts 212. Each bolt is passed through a spacer 214. The spacer 214 positions the bridge 210 offset from the bridge support 202 and adjacent the conveyor 80*b*. The bridge 210 is an elongate member with an upwardly tapered entrance ramp 216, a horizontal cam surface 218 and a downwardly tapered exit ramp (not illustrated). A bottom edge 219 of the bridge 210 is vertically higher relative to the horizontal plane in which the pin 30 of the cups 10 travel on the continuous conveyor 80*b*.

A solenoid 222 mounts at the upstream end of the bridge support 202 adjacent the entrance ramp 216. The solenoid 222 rotates a shaft between two positions as indicated by the arrows. A bridge strut 224 having an L-shape attaches at the end of one leg to the shaft of the solenoid 222. A second leg of the bridge strut 224 angles downward. A back surface 228 of the second leg defines a ramp. It will be appreciated that a similar discharge mechanism 115 as discussed above is also disposed in the discharge stations 112 for the conveyor 80*a*, as illustrated in FIG. 2.

When the solenoid 222 is energized, the shaft of the solenoid rotates and pivots the bridge strut 224 from a first position against the bottom of the bridge support 202 (as illustrated in phantom lines) to a second position adjacent the entrance ramp 216 of the bridge 210. In this second position, the back surface 228 of the bridge strut 224 acts as an extension of the upward tapered entrance ramp 216 of the bridge 210. The back surface 228 thus extends through the horizontal plane in which the pin 30 travels. When the solenoid 222 is de-energized, the solenoid returns the shaft to its original position, thereby rotating the bridge strut 224 away from the bridge 210 back to its first position against the bridge support 202. In this first position, the back surface 228 of the bridge strut 224 is disposed below the horizontal plane in which the pin 30 travels.

The operation of the weighing and sorting machine as described now is discussed. First with reference to FIG. 2, the supply bin 94 receives a supply of articles. Typically the articles to be weighed and sorted into containers having a label weight are fruits or vegetables, such as apples, pears, potatoes, onions or the like. These articles have varying weights and typically are sold grouped in bags with articles having similar weights. The conveyor 100 moves the articles in the bin 94 to the roller separator 96. The articles gather into rows and transfer from the roller separator 96 to the singulator 98. This maintains an orderly flow of articles from the supply bin 94 to the conveyors 80. The singulator 98 funnels the articles into single file as the conveyor 102 moves the articles through the singulator 98. Each article exits at 105 onto one of the cups 10 carried by the conveyor 80. As illustrated in FIG. 4, the walls 107 in the V-shape trough of the guide section 106 guide one of the articles onto a single cup 10. The wall 108 prevents articles from leaving the loading zone except on a cup 10. Each of the cups 10 thus holds one of the articles in the cavity 24 to be weighed and sorted.

The continuous conveyor 80 carries the cup 10 from the loading zone 72 along the elongate track 130 to the weighing zone 74. With reference to FIGS. 7 and 7A, the support for each cup 72 on the scale 12 shifts in the weighing zone 74 from the pivot shaft 44, the chain clip 46, and the track 130, to the pin 30 and the L-shape arm 32 of the cup 72. The cup 10 travels on the entrance ramp 142. The upper cam surfaces 150 and 152 of the spaced-apart rails 146 and 148 in the entrance ramp 142 taper upwardly in the direction of travel of the continuous conveyor 80. The beginning of the cam surfaces 150 and 152 in the entrance ramp 142 are vertically lower than the free end 34 of the arm 32 and the pin 30 extending from the inside wall 20 and the outside wall 18 of the cups 10. The rods 122, disposed in a horizontal plane vertically higher than that of the free end 34, pass over the camming surface 150 of the entrance ramp 142. The ends of the rods 122 are spaced apart from the rail 64 (see FIG. 7A) and the ramps 148 and 160, and thereby move beside the rail and the ramps without interference.

As the conveyor carries the cup 10 longitudinally along the side rails 146 and 148, the upwardly tapered cam surfaces 150 and 152 come into contact with the bottom sides of the pin 30 and the free end 34. The pin 30 intersects and travels on the upper cam surface 152 of the rail 148. The free end 34 of the arm 32 intersects and travels on the upper cam surface 150 of the rail 146, as best shown in FIG. 7. The cup 10 moves upward, and as the cup elevates, the ends 46 of the pivot shaft 44 guide the vertical movement by traveling in the slots 26. At this point, the cup 10 rests on the pin 30 and the arm 32 independently of the chain clip 46. The cup 10 accordingly is weighed on the scale independently of the conveyor by using the lost-motion pivot pin 44 and slot 24.

The conveyor 80 moves the cup 10 off the upper end of the entrance ramp 142 onto the side rails 62 and 64 of the scale 12. In this position, the weight of the cup 10 and its contents is imparted to the surfaces 66 and 68 of the side rails 62 and 64 by the pin 30 and the free end 34. The free end 34 slidably contacts the cam surface 66 of the side rail 62; the pin 30 slidably contacts the cam surface 68 of the side rail 64. A sensor (not illustrated) detects when the pin 30 passes onto the cam surface 68. One such sensor is a photosensor electrically connected to the controller and carried by a flange in the weighing zone 74. The pin 30 momentarily breaks a beam of light emanating from a light source carried by a second flange. When the beam of light is broken, a first signal is provided the controller to indicate that a cup 10 is fully on the scale 12. Similarly, a second signal is transmitted to the controller by a second photosensor and light source positioned on flanges adjacent the end of the side rail 64. The second signal is generated when the pin 30 moves off of the cam surface 68 onto the exit ramp 144.

With the cup 10 fully on the scale 12, the weight of the cup and the article is measured. The load cell provides signal proportional to the weight detected by the load cell for both the cup 10 and its article. An analog-to-digital converter (not shown) converts the signal corresponding to the weight of each loaded cup 10 as the cup 10 travels over the side rails 62 and 64 of the scale 12. An enabling signal from the sensor directs the controller to begin averaging the instantaneous weight signal over the time that the loaded cup 10 travels on the scale 12. The controller determines the article weight by subtracting the previously-determined tare weight for the cup from the gross weight of the cup and its contents. The controller stores the net weight of the article in each cup.

The conveyor 80 continues moving and the cup 10 moves in sequence from the scale 12 to the exit ramp 144. The free end 34 of the arm 32 and the pin 30 of the cup 10 transfer onto the upper cam surfaces 158 and 160 of the side rails 154 and 156. These side rails taper downwardly in the direction of travel of the continuous conveyor 80. In doing so, the support for the cup 10 switches from the free end 34 and the pin 30 back to the pivot shaft 44, the chain clip 48, and the track 130. The cup 10 thereby lowers with respect to the pivot shaft 44. As the cup 10 moves downwardly, the ends 46 are guided in the slots 24 to again contact the upper extent of the slots 24. While the cup 10 moves on the exit ramp 144, the next cup in sequence moves on the scale 12 and its weight is being computed, as described above.

The continuous conveyor 80 carries the cup 10 and its article through the discharge zone 76 for selective discharge of the article into a group of other articles having a similar weight. The weighing and sorting apparatus 70 illustrated in FIG. 2 includes the three separate discharge stations, **112*a*, 112*b*, and 112*c* in the discharge zone 76. As is known in the art, a greater or lesser number of such discharge stations may be included. Each station 112 includes the discharge mechanism 115 shown in FIG. 8. The discharge mechanism mounts on the outside of the conveyors 80*a* and 80*b* and does not interfere with the rods 122 and the fabric flaps 120 on the inside of the conveyors. The controller selectively activates the solenoid 222 in the appropriate station 112 to cause a selected cup, such as cup 10*c* shown in FIG. 8 to pivot and discharge its article from the cavity 24. The article moves out of the cavity into one of the fabric flaps falling into the receiving area 116 above the take-away conveyor 114. The fabric flap 120 cushions the transfer of the article from the cup 10 to the take-away conveyor 114**.

The pivotable bridge strut 224 is at a first position against the bridge support 202 when the solenoid 222 is not energized, as shown in phantom in FIG. 8. When an article is selected for discharge at the station 112, the shaft of the solenoid 222 rotates, as indicated by the arrows, pivoting the bridge strut 224 from its first position to its second position adjacent the entrance ramp 216 of the bridge 210. The pin 30 of the selected cup **10*c*, moving in a horizontal plane by the continuous conveyor 80, intersects the upwardly-tapered bridge strut 224. The pin 30 then moves upwardly along the back surface 228 of the strut 224 and onto the entrance ramp 216, and this upward movement begins to pivot the cup 10*c* upwardly around the pivot shaft 44. As the cup 10 reaches the horizontal cam surface 218, the cup 10*c* reaches its maximum angle of pivot and the article contained in the cavity 24 tips inwardly from the cup onto the fabric flap 120 carried by the rod 122. The fabric flap 120 drops into the receiving area 116 above the take-away conveyor 114 cushioning the drop of the article onto the take-away conveyor from the cup 10*c*. The conveyor 20 continues moving and the pivoted cup 10*c* travels along the downwardly tapered exit ramp. This causes the cup 10*c* to pivot around the pivot shaft 44** from the second pivoted position back to the first horizontal position.

The rotatable solenoid 222 de-energizes when the pin 30 contacts and begins moving up the entrance ramp 216. This causes the shaft of the solenoid 222 to rotate to its first position, returning the bridge strut 224 to its first position against the bridge support 202. Thereby, only the selected cup **10*c* travels onto the bridge 210. The solenoid 222 of each discharge mechanism 200 is connected to the controller. A pulse proportional to the speed of travel of the conveyor 80 is fed to the controller so that the controller can determine when a cup has traveled the known distance between the weighing zone and a selected discharge zone. The selective actuation of the solenoid 22 associated with the particular discharge station 112*a*, 112*b*, or 112*c*, is dictated by the weight detected for the particular article in the weighing zone 74. The cups 10 continue to move over the sprocket 90 and along the return flight 88** for receiving another article in the loading zone.

As illustrated in FIGS. 4, 7, and 7A, the rods 122 carrying the fabric flaps 120 travel in a horizontal plane higher than the horizontal plane in which the free end 34 travels. The rods 122 thus pass over the entrance ramp 142, the scale 12, and the exit ramp 144. The present invention thereby provides a cup and scale for an article sorting apparatus using a plurality of fabric flaps carried between parallel conveyors to receive gently articles selectively discharged for grouping with other articles.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. An article holding apparatus for an article weighing and sorting apparatus with two spaced-apart, parallel continuous conveyors which pass sequentially through a loading zone, a weighing zone with a scale having a weigh platform of unequal height, and a discharge zone, and a plurality of spaced-apart rods connected normal to said conveyors with a fabric flap attached to each rod for receiving an article discharged selectively in said discharge zone for packaging with other articles having such similar selectable weight, the apparatus comprising:

a cup having a cavity for holding an article received therein while said cup passes through said loading zone;

a first support surface and a second support surface operatively associated with the cup for supporting said cup on the weigh platform, said first support surface extending downwardly from one side of said cup and said second support surface extending downwardly from another side of said cup; and said first support surface being lower than said second support surface so that the cup is horizontal on the weigh platform as the cup passes through the weighing zone.

2. An article weighing and sorting apparatus, comprising:

a pair of spaced-apart, parallel continuous conveyors which pass through a loading zone, a weighing zone, and a discharge zone;

a plurality of cups pivotally attached to each of said conveyors for selective pivoting in said discharge zone toward the other conveyor and comprising a cavity for receiving an article while said cup is in said loading zone, each cup comprising:

a first support surface and a second support surface for supporting said cup on a scale in said weighing zone, said first support surface disposed at a free end of an arm extending outwardly and downwardly from a side of said cup, said second support surface disposed on said lower side of a pin extending laterally from an opposite side of said cup, said first support surface being lower than said second support surface;

means for supporting said cup solely on said support surfaces independently of the conveyor associated with the cup, during the weighing of said cup;

means for pivoting a selected cup in a discharge zone to discharge said article from said cup;

means for receiving a discharged article;

a plurality of rods disposed normal between said two conveyors, each rod connected at its respective longitudinal ends to one of said carriers, said support surface of said first member being in a plane vertically lower than said rods; and a fabric flap attached to each rod for gently communicating an article pivoted from a selected cup to said receiving means.

3. Apparatus as in claim 2, wherein the arm is L-shaped.

4. An article weighing and sorting apparatus, comprising:

a continuous conveyor which passes through a loading zone, a weighing zone having a weighing platform, and a discharge zone;

a plurality of cups each for receiving an article while in said loading zone, each cup attached to said conveyor for selective pivotal movement in said discharge zone about an axis generally parallel to said direction of movement of said conveyor, each cup comprising a first support surface and a second support surface for supporting said cup on a scale in said weighing zone, said first support surface being disposed lower from said cup than said second support surface;

a first rail connected to the weighing platform and aligned with said first support surface;

a second rail connected to the weighing platform and aligned with said second support surface;

the first rail being lower than the second rail so that the cup is horizontal on the weighing platform as the cup passes through the weighing zone;

means for pivoting a selected cup in a discharge zone to discharge said article from said cup;

means for receiving a discharged article; and said first support surface is at a free end of an arm extending outwardly and downwardly from a side of said cup.

5. The article weighing and sorting apparatus as recited in claim 4, wherein said second support surface is defined by a lower side of a pin extending laterally from an opposite side of said cup.

6. An article weighing and sorting apparatus, comprising:

a continuous conveyor which passes through a loading zone, a weighing zone having a weighing platform, and a discharge zone;

a plurality of cups each for receiving an article while in said loading zone, each cup attached to said conveyor for selective pivotal movement in said discharge zone about an axis generally parallel to said direction of movement of said conveyor, each cup comprising a first support surface and a second support surface for supporting said cup on a scale in said weighing zone, said first support surface being disposed lower from said cup than said second support surface;

a first rail connected to the weighing platform and aligned with said first support surface;

a second rail connected to the weighing platform and aligned with said second support surface;

the first rail being lower than the second rail so that the cup is horizontal on the weighing platform as the cup passes through the weighing zone;

means for pivoting a selected cup in a discharge zone to discharge said article from said cup;

means for receiving a discharged article;

a second continuous conveyor parallel to and spaced apart from said first conveyor and including a plurality of said cups;

the first support surfaces of the cups on the first conveyor faces the same surfaces of the cups on the second conveyor;

a plurality of rods connected to and extending between said two conveyors; and a fabric flap attached to each said rod for gently transferring an article discharged from a selected one of said cups to said receiving means, wherein said first support surfaces extend downwardly below the plane in which said rods travel, so that the rods do not interfere with the first rail as the rods pass through the weighing zone.

* * * * *